United States Patent [19]

Labbé et al.

[11] Patent Number: 4,609,304

[45] Date of Patent: Sep. 2, 1986

[54] APPARATUS FOR ENABLING A SELF-CONTAINED SUBMERSIBLE MODULE INCLUDING A LENGTH OF CONDUIT FOR CONNECTION TO A COLLECTOR TO BE REPETITIVELY PUT INTO PLACE AND REMOVED

[75] Inventors: Roland Labbé; Jean-Luc Quistrebert, both of Saint Luce sur Loire, France

[73] Assignee: Alsthom-Atlantique, Paris, France

[21] Appl. No.: 543,559

[22] Filed: Oct. 19, 1983

[30] Foreign Application Priority Data

Oct. 26, 1982 [FR] France ..... 82 17871

[51] Int. Cl.[4] ..... E21B 43/013; F16L 1/04

[52] U.S. Cl. ..... 405/170; 405/169; 166/339; 166/340; 166/347

[58] Field of Search ..... 405/168–170, 405/191, 195; 166/338, 339, 340, 343, 346, 347, 365, 366

[56] References Cited

U.S. PATENT DOCUMENTS

| | | | |
|---|---|---|---|
| 3,732,923 | 5/1973 | Fowler | 166/347 X |
| 4,086,778 | 5/1978 | Latham et al. | 405/169 X |
| 4,286,665 | 9/1981 | Walker | 166/339 |
| 4,378,848 | 4/1983 | Milberger | 166/366 X |
| 4,452,312 | 6/1984 | Roblin | 405/170 X |

*Primary Examiner*—Cornelius J. Husar
*Assistant Examiner*—Nancy J. Stodola
*Attorney, Agent, or Firm*—Sughrue, Mion, Zinn, Macpeak & Seas

[57] ABSTRACT

Apparatus for enabling a self-contained submersible module including a length of conduit for connection to a collector to be repetitively put into place and removed. The collector (3) is located on the sea bed, and said length of conduit (14) and said collector (3) have mating ends fitted with a releasable connector suitable for establishing said connection when the ends to be connected come into end-to-end engagement. The length of conduit (14) is mounted in the module (2) on a carriage (7) to enable said length of conduit to be moved out from said module to bring one of its ends (13) into contact with the end (5) of the collector. Once the length of conduit has made connection with the end of the collector, the carriage also enables said length of conduit to be moved in the opposite direction pulling said collector with it in order to connect the other end of the conduit to a well head (1). The improvement lies in an end portion of the length of said collector being housed inside a fixed and rigid sheath (6) of greater inside cross section than the overall cross section of the collector. The collector inside the sheath follows a curved path and is fixed to the sheath (6) only at the furthest end (8) of the sheath from the connection with said module. This ensures that there is always sufficient clearance for the collector to move when pulled by said length of conduit on the carriage, even if the sheath becomes buried in sea bed material (11).

2 Claims, 6 Drawing Figures

APPARATUS FOR ENABLING A SELF-CONTAINED SUBMERSIBLE MODULE INCLUDING A LENGTH OF CONDUIT FOR CONNECTION TO A COLLECTOR TO BE REPETITIVELY PUT INTO PLACE AND REMOVED

BACKGROUND OF THE INVENTION

Published French Patent Application No. 2,500,525 describes an off-shore oil production installation which includes a plurality of well heads, each of which is associated with a corresponding auxiliary module which includes moving members such as valves. One side of each of these auxiliary modules is connected to the well head and the other side is connected to a collector which leads to a central structure where all the collectors are brought together and where further specialized accessory modules are located. The auxiliary modules are removable to enable them to be lifted to the surface for maintenance and for repair. It is thus necessary to leave a degree of play both between each module and its associated well head, and also between each module and the said collector once the module has been disconnected from these two items. However, the internal conduit(s) along the collector must be continued right up to the well head without any step, groove bump, or constriction of the conduit in the vicinity of the connectors since tools have to be sent along the conduit(s). This implies that the connections must be end-to-end connections going right up to the ends of the parts to be connected. Taking this into account as well as the play which is required to enable the auxiliary module to be inserted and removed, it is necessary to find the end of the collector located outside the auxiliary module and to pull it inside the module thereby making it possible to make the connection on the other side of the auxiliary module to the well head. This happens because the conduits cannot be looped inside the modules to give them a degree of elasticity, since the modules are of relatively small size and the loops would have to be of large diameter to pass the tools. This means that the collectors have to be pulled, and also that the auxiliary module described in the above-mentioned patent application includes a cradle which is movable sideways and which itself includes a length of conduit to be connected at one end to the collector and at the other end to the well head. Nonetheless, there reamains a difficulty in that said collectors, particularly in the vicinity of their ends, may become more or less dug-in over the course of time, which can make disconnection impossible since, once a collector is buried, it is no longer certain that it will remain flexible enough for its end to be pushed away by moving said cradle sideways in order to leave the minimum play necessary for the module to be removed.

Preferred embodiments of the present invention mitigate this drawback.

SUMMARY OF THE INVENTION

The present invention provides apparatus for enabling a self-contained submersible module to be repetitively put into place and removed, the module including a length of conduit for connection at one end to a collector located on the water bottom, said length of conduit and said collector having mating ends fitted with releasable connector means suitable for establishing said connection when the ends to be connected come into end-to-end engagement, said length of conduit being mounted in said module on a carriage to enable said length of conduit to be moved out from said module to bring one of its ends into contact with the end of the collector, and once the length of conduit has made connection with the end of the collector to enable said length of conduit to be moved in the opposite direction pulling said collector with it, the improvement wherein an end portion of the length of said collector is housed inside a fixed and rigid sheath of greater inside cross section than the overall cross section of the collector, said collector inside said sheath following a curved path and being fixed thereto only at the furthest end of the sheath from the connection with said mudle, thereby ensuring sufficient clearance for the collector to move when pulled by said length of conduit on the carriage.

Preferably the end of the sheath which is closest to said module is located in a bell mount including means for locking the sheath in place therein, said end of the sheath further including means for releasably locking the collector in place in a retracted position when not connected to the module.

BRIEF DESCRIPTION OF THE DRAWINGS

An embodiment of the invention is described by way of example with reference to the accompanying drawings, in which.

MORE DETAILED DESCRIPTION

Figure 1:
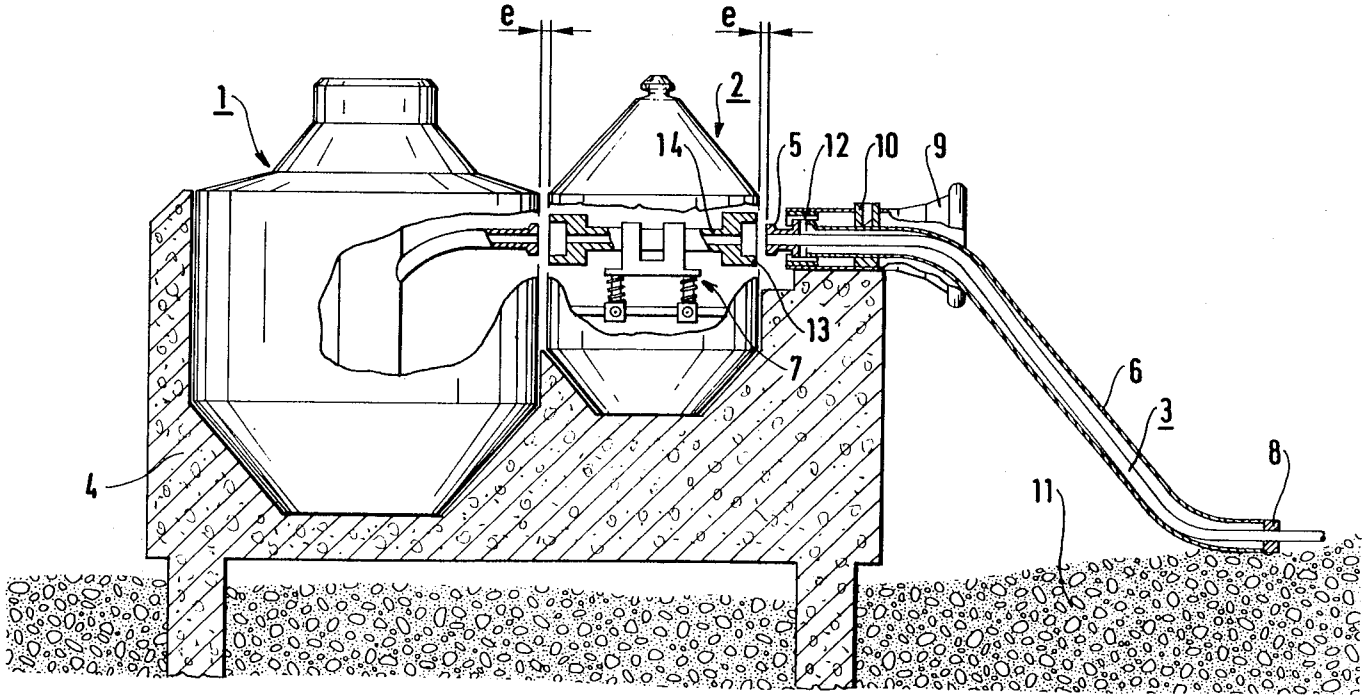
FIG. 1 is a diagrammatic and partially cut away side view of an off-shore oil-producing well head having an auxiliary module and a collector for transporting the crude produced.
Figure 2:
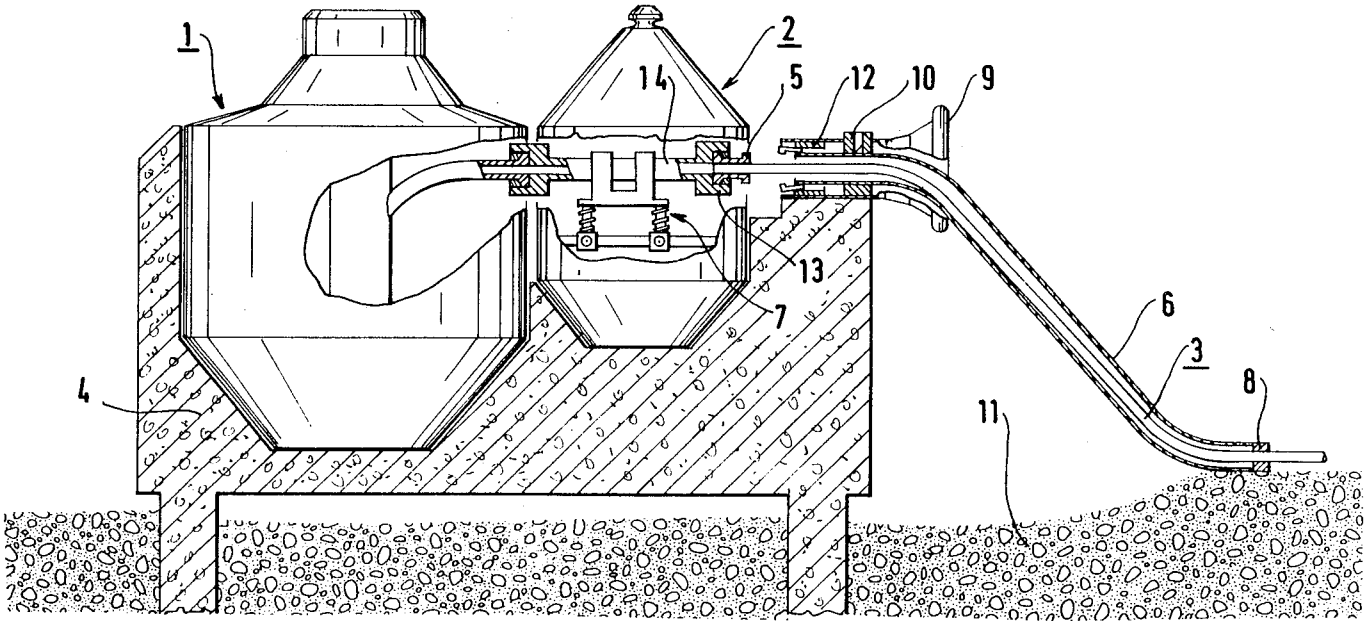
FIG. 2 is a similar view to FIG. 1, but shows a position in which the collector is connected to the auxiliary module and the auxiliary module is connected to the well head thereby providing continuity of the, or each, internal conduit in the collector.

With reference to FIGS. 1 and 2, a well head assembly 1 is associated with an auxiliary module 2 and a collector 3 which may comprise a plurality of conduits joined together. The auxiliary module generally houses valves and other moving components which may require maintenance or repair, implying that the module must be repetitively insertable and removable. The well head 1 and the auxiliary module 2 are positioned and fixed in a base member 4. To enable the auxiliary module 2 to be inserted and removed it is necessary, when the module is in the disconnected position as shown in FIG. 1, to leave some minimum amount of play e between the module and the well head 1 and also between the module and the end of a male connector 5 situated at the end of the collector 3.

In accordance with the invention, the end of the collector 3 passes through a sheath 6 which leaves clearance for the end of the collector 3 to move when pulled (after a connection has been made and as can be seen in FIG. 2) by a carriage 7 which is situated in the module 2 and which moves to make the connection between the auxilary module 2 and the well head 1. To provide said clearance and as can be seen in FIGS. 1 and 2, the sheath 6 is a swan-necked, S-curved rigid tube having an inside section which is considerably larger than the outside section of the collector 3. Furthermore, the collector 3 is fixed to the sheath 6 at its end 8 which is distant from the module 2. The length of the collector 10 inside sheath 6 is greater than the length of the sheath. The other end of the sheath 6 is positioned and held in a bell-mouth 9 mounted on the base 4. Fixing means such as a bolt 10 fix the sheath 6 in the bell-mouth 9. The other end 8 of the sheath 6 rests on the sea bed 11, and the collector 3 runs over the sea bed to connect with some other unit, eg. on a central structure which houses units common to a plurality of satellite well heads.

Figure 3:
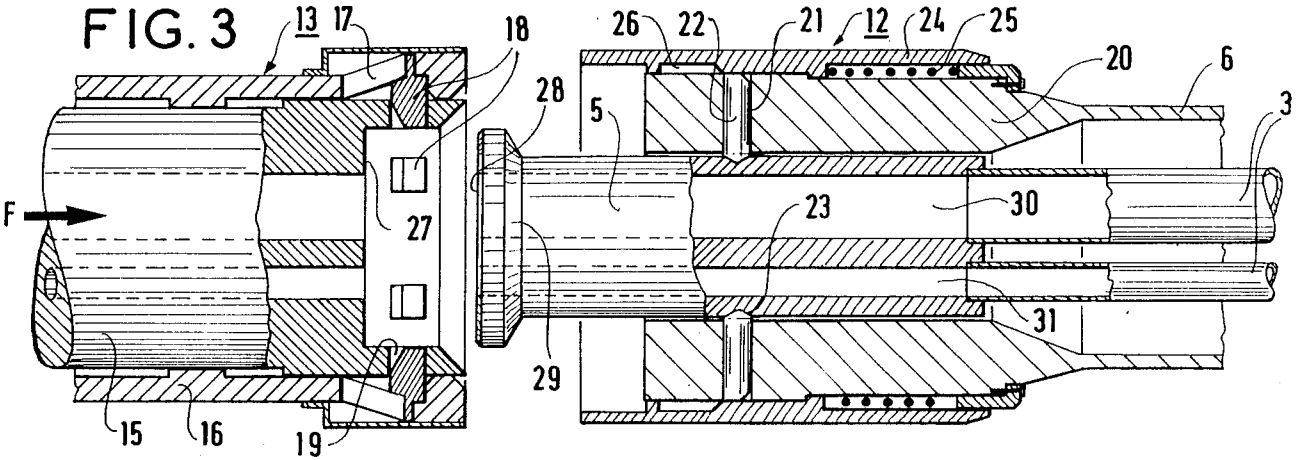
FIGS. 3, 4, 5, and 6 are partially cut-away side views in greater detail showing various positions of a device for connecting the collector to the auxiliary module and a device for locking and unlocking the collector to a sheath.
Figure 6:
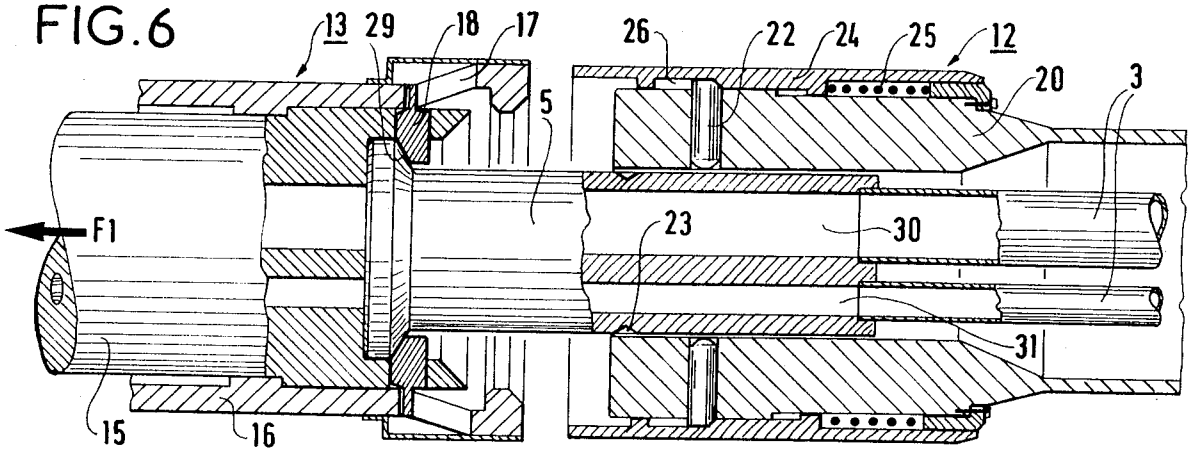

The sheath 6 includes locking means or locking assembly 12 which are shown diagrammatically in FIGS. 1 and 2 and in greater detail in FIGS. 3 and 6 for holding the collector 3 when in the retracted position as shown in FIG. 1. Means are provided to unlock the collector 3 when a female connector 13 and an associated length of conduit 14 on a the carriage 7 come close to a corresponding male connector 5 on the collector 3 for connection therewith.

In practice, the collector's own resilience means that it tends towards the output position, ie. the position shown in FIG. 2, and therefore the carriage 7 must exert force to move in into the retracted or locked position shown in FIG. 1. This position also provides the required minimum play e for extracting the module 2. If the sheath 6 is not present, it is never certain that the collector can be pushed back in the bell mouth 9, since it is always possible that over a period of time the collector 3 has become covered with sea-bed material thereby preventing any movement.

The system for locking and unlocking the collector 3 in the sheath 6 is now described with reference to FIGS. 3 to 6.

The right hand side of FIG. 3 shows the end of the collector 3 which comprises two conduits in the example shown and which is fixed in said male connector 5. The right hand side of the figure also shows the end of the sheath 6 which includes the locking assembly 12 for locking the collector 3 in position. The bell-mouth 9 through which the entire end of the sheath 6 is initially inserted is not shown in FIG. 3, since it is off the right hand side of the figure. The left hand side of FIG. 3 shows the female connector 13.

The female connector comprises a body 15 fixed to a length of conduit 14 (see FIGS. 1 and 2) which is identical to the collector 3, and a carriage sliding ring 16 having openings 17 which serve as guide ramps for receiving a series of moving locking fingers 18 which pass radially through holes 19 in the body 15.

The assembly 12 for locking the collector 3 in the sheath 6 includes a body 20 fixed to the end of the sheath 6. The body 20 has a series of holes 21 having radial axes about the longitudinal axis of the male connector 5. A locking peg 22 is slidably mounted in each of said holes 21, and the pegs 22 have conical heads for co-operating engagement in the locked position of the collector 3 in the sheath 6 with matching conical recesses 23 made around the periphery of the male connector 5. To prevent the locking pegs 22 from disengaging their respective recesses 23, a sheath sliding ring 24 is biassed by a spring 25 to cover the outer ends of the pegs 22. In order to unlock the collector 3 from the sheath 6, the sliding ring 24 includes a groove 26 which receives said outer ends of the pegs 22 when the groove is suitably placed over the holes 21. The pegs 22 disengage the conical recesses 23 naturally under the camming effect of the collector 3 whether it is urged by its own resilience or by traction from the carriage 7 once connected thereto.

Figure 4:
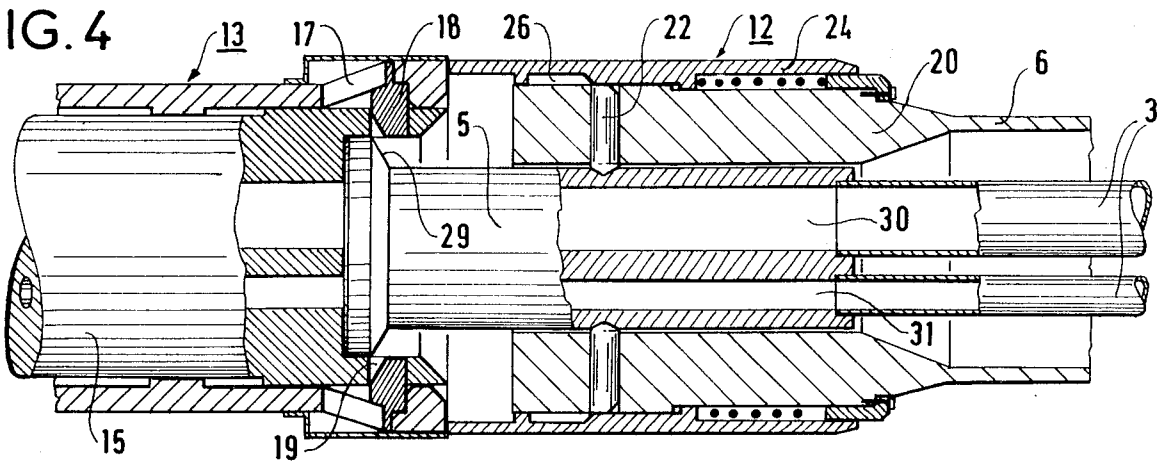
Figure 5:
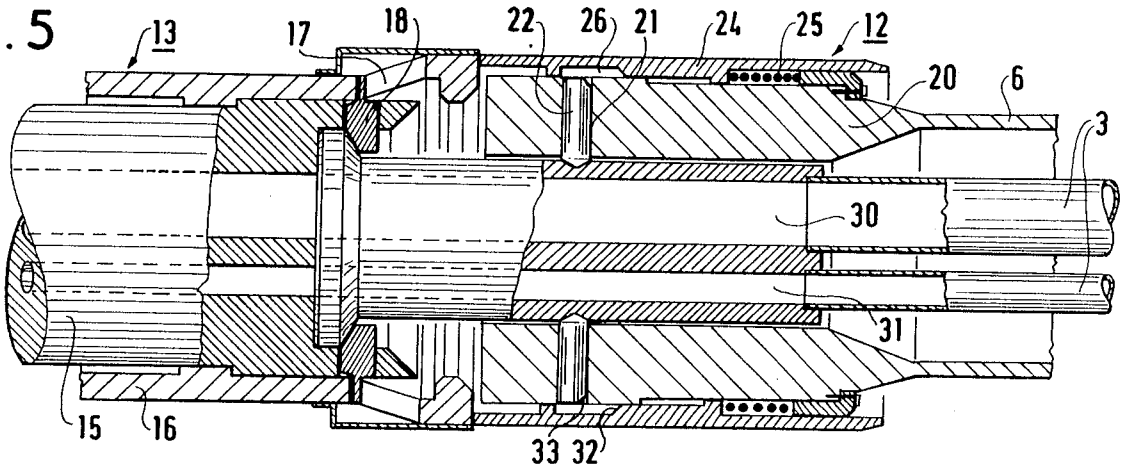

In FIG. 3 the collector is in the locked position and the assembly is disconnected. Connection and unlocking then take place as follows: the carriage 7 is moved in the direction of arrow F (to right in the figures) until the position shown in FIG. 4 is reached with the face 27 of the body 15 abutting against the front face 28 of the male connector 5. Then the sliding ring 16 on the carriage is moved in the same direction (ie. to right in the figures) thereby camming the fingers 18 radially inwardly through the holes 19 to bear against the sloping face 29 at the back of the rim around the leading end of the male connector 5. This ensures an uninterrupted sealed connection between the conduits 30 and 31 in the collector 3 and the corresponding conduits in the carriage 7. The ring 16 is moved by conventional hydraulic actuator means, not shown, which are controlled from the surface via an umbilical cord lodged in the cable by which the module 2 is lowered and raised. A module handling tool is provided at the end of the cable as described in the above-mentionned French Pat. publication No. 2,500,525. The assembly is then in the position shown in FIG. 5. It can be seen that during its travel, the sliding ring 16 on the carriage 7 comes into contact with the sliding ring 24 on the sheath 6 and thus pushes the sheath ring 24 against the spring 25 until the groove 26 comes into position over the outer ends of the pegs 22. In this position, since conection has been made and the collector unlocked, all that remains to be done is to move the carriage in the opposite direction along arrow F1 (FIG. 6) pulling the collector so that the other end of the carriage can be connected to the well head 1 on the other side of the module 2. The rigid sheath leaves plenty of clearance for the collector 3 with no danger of the clearance becoming clogged with bottom material. The act of pulling the collector 3 towards the well head 1 cams the pegs 22 radially outwardly so that they enter the groove 26. The sheath sliding ring 24 can thus move a short distance in the direction of the arrow F1 under the thrust of the spring 25, but its travel is limited by the sloping edge 32 of the groove 26 coming into contact with the chamfered edges 33 of the pegs 22.

When it is desired to remove the module 2 for maintenance, ie. when the collector 3 is to be disconnected and locked in the sheath 6 in such a position as to leave the minimum required play e, operations proceed as follows:

After disconnecting the carriage from the well head, but before moving the carriage back towards the sheath, the carriage sliding ring 16 is moved away from the sheath 6. This has two effects. Firstly the fingers 18 are cammed radially outwardly, and secondly the carriage sliding ring 16 is moved to a position in which it will not come into contact with the sheath 6 sliding ring 24. The carriage 7 is then moved towards the sheath until the conical recesses 23 of collector 3 come into alignment with the pegs 22. At this moment, the spring 25 which is acting on the ring 24 and also on the pegs 22 (via the sloping edge 32 of the groove 26 and the chamfered edges of the pegs 22), cams the pegs 22 into engagement with the conical recesses 23. This movement allows the sheath sliding ring 24 to move fully towards the carriage, thereby locking the collector 3 to the sheath 6. The carriage 7 can then be moved away from the collector, ready for the module 2 to be hoisted to the surface.

Clearly the locking and unlocking system described has been given merely by way of example and could be replaced by various other effective locking systems, eg. a jack under direct hydraulic control from the surface.

We claim:

1. Apparatus for enabling a self-contained submersible module to be repetitively put into place and removed, the module having a base and including a length of conduit for connection at one end to a collector located on the water bottom, said length of conduit and said collector having mating ends, releasable connector means for establishing a connection between the length of the conduit and the collector when the ends to be connected come into end-to-end engagement fitted to the ends of said length of conduit and said collector, a carriage mounting said length of conduit, said carriage being mounted in said module for movement towards and away from the end of the collector to enable said length of conduit to be moved out from said module to bring said one end into contact with the end of the collector, and once the length of conduit has made connection with the end of the collector to enable said length of conduit to be moved in the opposite direction by pulling said collector with it, the improvement comprising:

a generally swan-necked, S-curved rigid sheath fixedly coupled at one end to said base and extending outwardly from said base in a direction away from said carriage, said rigid sheath having a greater inside diameter than the outside diameter of the collector, said collector extending inside of said sheath and following a curved path of said swan-necked, S-curved rigid sheath with limited play therebetween, means for fixing said collector to said rigid sheath at the end of the sheath remote from the connection of said sheath with said module base, with the portion of the collector within said sheath being of a length in excess of the length of said sheath, and wherein the diameter of said rigid sheath in excess of the outside diameter of the collector is such as to ensure sufficient play for the collector to move with the carriage when pulled by said length of conduit on the carriage in a direction away from said sheath and permitting the collector to be pushed back into the sheath when pushed by the length of the conduit on the carriage moving in a direction towards said sheath, irrespective of the collector being covered with seabed material.

2. Apparatus according to claim 1, further comprising a bell mouth mounted to said base the end of said sheath proximate to said module being located in said bell mouth, said bell mouth including means for locking said sheath in place therein, and the end of said sheath including means for releasably locking the collector in place in a retracted position within said sheath when said collector is disconnected from said length of conduit borne by said carriage.

* * * * *